United States Patent [19]

Eggert et al.

[11] Patent Number: 4,672,672

[45] Date of Patent: Jun. 9, 1987

[54] MINIATURE HEARING AID

[75] Inventors: Albert Eggert; Jürgen Montag; Manfred Müller; Peter Wiener, all of Berlin, Fed. Rep. of Germany

[73] Assignee: Robert Bosch GmbH, Stuttgart, Fed. Rep. of Germany

[21] Appl. No.: 830,658

[22] Filed: Feb. 18, 1986

[30] Foreign Application Priority Data

Mar. 30, 1985 [DE] Fed. Rep. of Germany ..... 3511792

[51] Int. Cl.[4] ..... H04R 25/02

[52] U.S. Cl. ..... 381/69; 381/68.6

[58] Field of Search ..... 381/68, 69, 91; 179/102 E

[56] References Cited

U.S. PATENT DOCUMENTS 4,532,649 7/1985 Bellafiore ..... 179/102 E
4,550,227 10/1985 Tøpholm ..... 381/69
4,585,089 4/1986 Tøpholm ..... 179/102 E
4,617,429 10/1986 Bellafiore ..... 381/69

FOREIGN PATENT DOCUMENTS 8323464 11/1983 Fed. Rep. of Germany .

*Primary Examiner*—Gene Z. Rubinson

*Assistant Examiner*—L. C. Schroeder

*Attorney, Agent, or Firm*—Frishauf, Holtz, Goodman & Woodward

[57] ABSTRACT

The housing is essentially spherically shaped, formed with a flattened end wall (14), through which a sound receiving opening (42) extends in axial direction, located eccentrically with respect to the spherical housing. A volume control button (50) covers the sound receiving opening, the volume control button being maintained by a small distance (h) spaced from the spherical end wall to permit entry of sound to the sound receiving opening, while preventing masking of the sound receiving opening by the finger of a user, and free entry of contamination thereto. Preferably, the button is connected to the volume control element by an inwardly extending collar (52) which snaps over an adjustment rim (35) on a volume control positioned axially centrally on a printed circuit board (31) secured within the housing and passing through a central opening (47) formed therein. The flat end wall (14) can be formed with additional openings to permit access to adjustment screwdriver heads (36) of trimmer resistors, the additional openings likewise being masked by the volume control button for protection and to prevent contamination.

14 Claims, 3 Drawing Figures

MINIATURE HEARING AID

REFERENCE TO RELATED PUBLICATION

German Utility Model DE-GM No. 83 23 464, registered Nov. 10,1983.

The present invention relates to hearing aids, and more particularly to a miniature hearing aid adapted to be worn immediately adjacent the auditory canal of a user, and having, essentially, truncated spherical shape.

BACKGROUND.

Hearing aids of the subminiature type, adapted to be worn immediately adjacent the auditory canal of a user, have previously been proposed—see German Utility Model DE-GM No. 83 23 464. The hearing aid there disclosed comprises a flat, hollow, cylindrical housing with a cover. The cover is rotatable to form an ON/-OFF switch and volume control element, and is located adjacent an opening into the housing which is adapted to conduct sound from outside,ambient space to a microphone located within the housing. The cover, simultaneously, forms the switch, volume control and end piece for the housing.

It has been found difficult to use hearing aids of this type since adjusting the volume control without, at the same time, modifying the sound entrance path to the interior of the housing, is cumbersome. In order to rotate the volume control - cover element of the housing, fingers of the user invariably cover the opening leading to the sound duct. If the user, adjusts the volume of the volume control for a suitable amplification, and then removes the finger, the actual amplification, with the finger removed, will be excessive,and the sound pressure waves applied to the inner ear of the user will be much too high, and are highly annoying. Even continued experience with the failure of the volume control to accurately reproduce volume with the finger present or removed, will not always result in satisfactory amplification due to differences in placement of a user's finger when making the adjustment and/or differences in the frequency range, general sound or noise level or the like which differentially affect sound transmission to the microphone 25 path or through the user's finger.

THE INVENTION

It is an object to provide a miniature hearing aid which can easily be adjusted by the user and in which the sound level will be independent of the placement of the user's hand or finger against the hearing aid so that the sound output from the hearing aid will be independent of presence or absence of manual control thereof. Additionally, the construction should be generally pleasing and effectively immune against contamination.

Briefly, the hearing aid structure comprises a housing which is, essentially, part-spherical, with a flattened surface or end wall. A movable user-engageable volume control button, essentially in form of a disk, is located adjacent the flattened end wall of the housing and essentially parallel thereto, rotatable about a shaft extending for example essentially centrally into the housing. In accordance with a feature of the invention, a sound receiving opening is located in the flattened end wall of the housing, passing therethrough,and located beneath the volume control button. The volume control button is spaced from the flattened end wall of the housing and hence the sound receiving opening by a small, predetermined distance h, which is just sufficient to permit sound to pass into the interior of the housing, while protecting the sound receiving opening from external contamination, and from masking by the finger of the user during adjustment of the volume control, that is, by rotating the volume control button about its axis.

The arrangement has the advantage that the exposed walls of the housing will be continuous and integral and not have any openings which could be covered, inadvertently, by the user's fingers and which may be subject to contamination.

In accordance with a particularly desirable feature of the invention, the ON/OFF switch-volume control button is secured to the housing by an arrangement which permits free passage of the button, located adjacent the sound receiving opening. The button should be arranged to snap into a matching volume control stem or rim and, for example, may be somewhat concave to cover a small chamber formed above the sound entrance opening, while protecting the sound entrance opening against contamination. The flattened end wall of the housing can be formed with additional openings which movably, yet quite snugly surround heads of adjustment or trimmer elements, for example trimmer potentiometers or resistors, to control overall amplification, frequency range and other adjustable elements of the hearing aid, for example by engagement with a trimmer-control screwdriver. The openings for the additional trimmer-adjustment heads likewise are located beneath, and protected by the volume control button so that, effectively, the interior of the housing is protected against contamination, humidity, and the adjustment potentiometers are protected against inadvertent readjustment.

DRAWINGS

DETAILED DESCRIPTION

Figure 1:
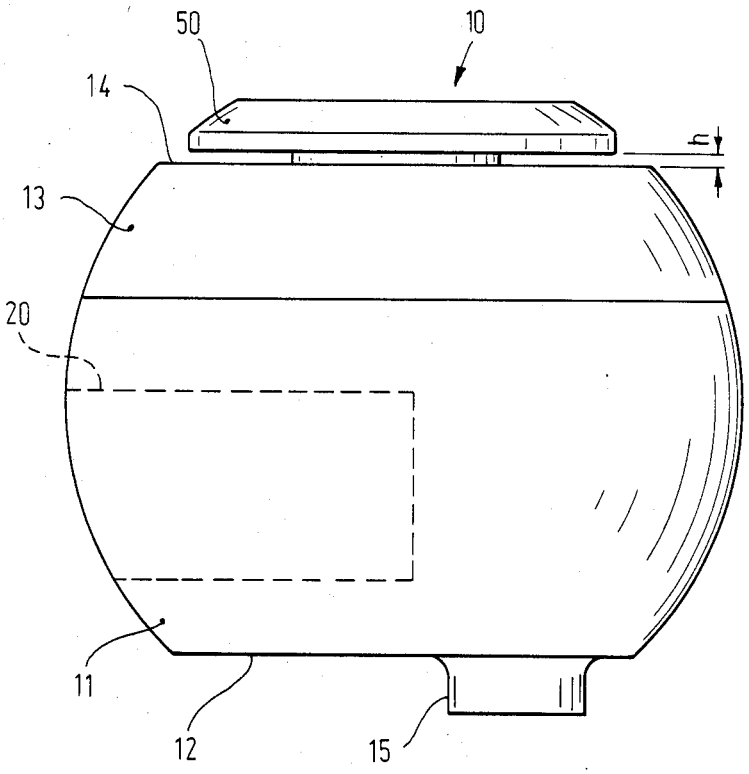
FIG. 1 is a side view of the hearing aid, to a substantially expanded scale.

The hearing aid 10, adapted to be worn immediately adjacent or at the end portion of the auditory duct of a user, has a housing formed in two parts. The lower part 11 of the housing is part-spherical; the upper part of the housing, matching against the lower part, fits the part-spherical circumference and is formed with a flattened end surface 14. The lower part 11 of the housing, likewise, is flattened at the bottom, as seen at 12, and interrupted by a hollow stub 15. A sound transducer 16—see FIG. 2—in form of an earphone, has its sound emitting opening 17 facing the interior of the stub 15, to provide, with the hearing aid assembled for use by a wearer, communication with the opening 18 at the free of the stub 15. A sound duct tube may extend from the end portion 17 of the earphone 16, and the stub 15 may have an additional sound canal or sound duct attached thereto, adapted to be introduced into the auditory canal of the user, as well known in hearing aids of this type.

Figure 2:
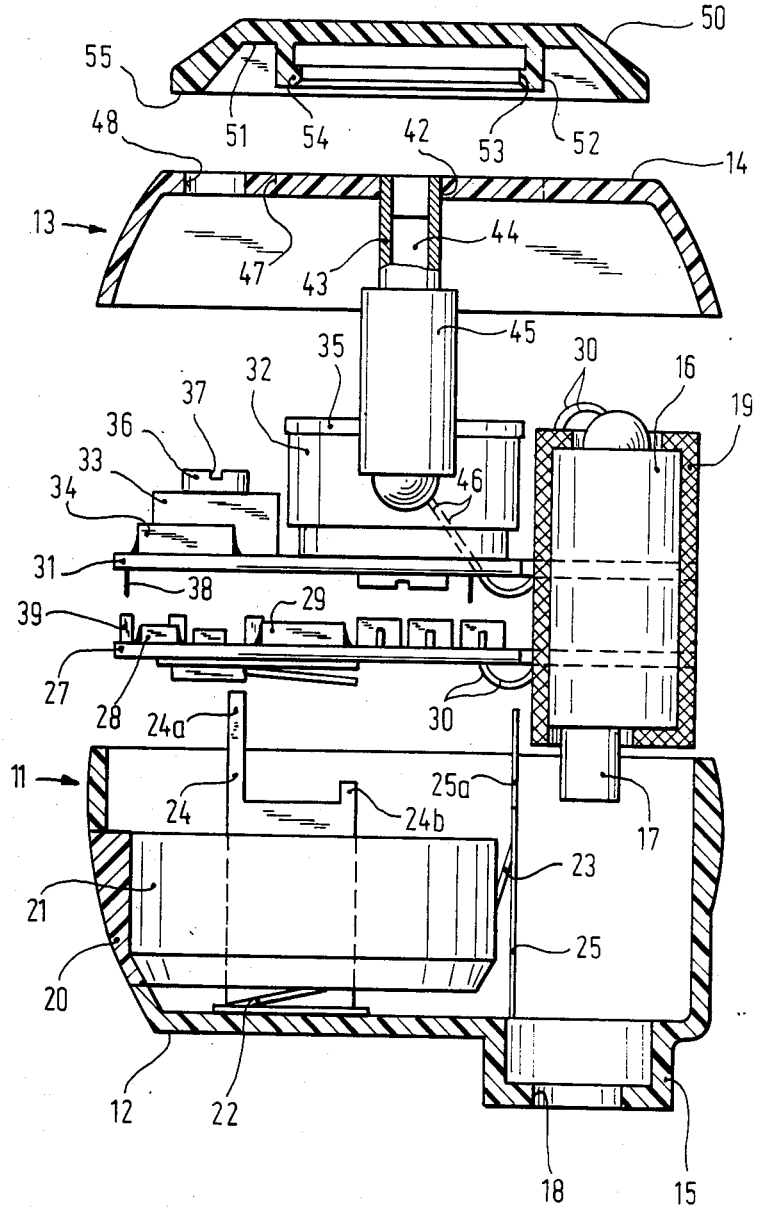
FIG. 2 is an exploded sectional view along line II—II of FIG. 3.

The lower part 11 of the housing is formed with a movable battery door 20 which, when closed, merges smoothly into the circumference of the housing 11, that is, is matched to the general spherical shape thereof. A battery 21, which may be a primary or a rechargeable cell, is located in a chamber closed off by the battery door 20. The negative terminal of the battery 21 is engaged by a first contact spring 22; the positive terminal is engaged by a second contact spring 23, both contact springs 22, 23 being located in the interior of the housing. The contact springs 22, 23 are electrically and mechanically connected to vertically extending contact spring portions 24, 25 (FIG. 2) forming mechanical and electrical connections from the battery to a first printed circuit board (PCB) 27. The contact springs 24, 25 are formed with extending tabs 24*a*, 24*b* and 25*a*, fitted in suitable openings of the first PCB 27. The PCB 27 supports electrical and electronic components 28, 29 of the amplifier system of the hearing aid, which are connected by conductors 30 with the transducer 16. The circuitry and the components used may be in accordance with any standard arrangement in the field,and the illustration of FIG. 2 is only schematic.

A second printed circuit board (PCB) 31 forms a carrier for a volume control adjustment element 32. The second PCB 31 further carries adjustment or trimmer resistors 33 and additional electrical and electronic circuit components, of which only one, component 34, is seen in FIG. 2. The volume control 32 is formed with a disk-like adjustment end portion or element 35. The trimmer resistor 33 has a screw head adjustment element 36 with a screwdriver slot 37. The second PCB 31 is connected to the first PCB 27 by connecting pins 38, preferably located at the bottom side of the second PCB 31, which are securely connected electrically and mechanically in bushings 39, likewise securely connected electrically and mechanically to suitable electrical conductors on the first PCB 27.

Figure 3:
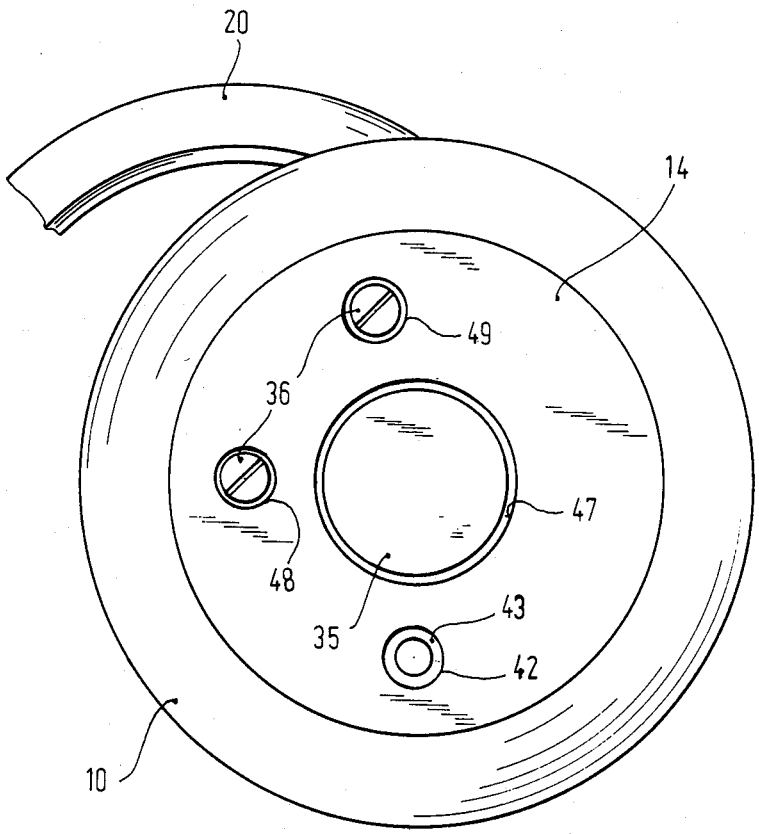
FIG. 3 is a top view of the hearing aid, with the adjustment or control button removed.

The upper portion 13 of the housing of the hearing aid 10 is formed with a flattened surface 14. In accordance with a feature of the invention, a sound transmission opening 42 (see FIGS. 2, 3), eccentrically located, passes through the flattened end wall 14, which opening 42 receives and is connected by a plastic flexible tube 43 (FIG. 2) to the sound receiving opening 44 of a microphone 45. Microphone 45 is, thereby, elastically secured on the upper housing portion 13. Electrical connections 46 connect the microphone to electrical conductors on the upper or second PCB 31. The flattened surface 14 of the second housing portion 13 is additionally formed with an axial opening 47—see also FIG. 3—which is provided for passage of the volume control adjustment element 35 of the amplifier portion 32 of the hearing aid. Two further eccentric openings 48, 49 (see FIG. 3) are provided, matched in location to permit passage of the adjustment heads 36 of the trimmer resistors 33.

The adjustment button 50 which is, preferably, inwardly concave and cap-like, is formed at its inner surface with a ring-shaped collar 52 which is so dimensioned that it can be snapped.over an external adjustment rim of the adjustment element 35. The collar 52, at its free end, is formed with an inwardly directed ring-shaped projection 53, merging externally into an outwardly tapering or inclined surface 54 which facilitates snap-on connection of the collar 52 over the rim of the volume control adjustment element 35. When in assembled condition, that is, when the cap 50 is snapped on the volume control, the volume control 32 can be adjusted by rotating the button 50. The volume control, as well known, may be integrated with an ON/OFF switch. The spacing is so dimensioned that a small distance h (see FIG. 1) will remain between the lower edge 55 of the button 50 and the surface 14, to permit sound to pass readily into the chamber defined beneath the concave inner surface of the button 50 and the opening 42 forming the sound entrance opening to the interior of the housing and leading to the microphone 45.

To provide for effective sound insulation, and prevent internal feedback, the earphone 16 is surrounded by a sound deadening, highly elastic covering or coating 19 which, for example, may be in mesh or foam form, as seen in FIG. 2.

Positive rotational engagement between the button 50 and the adjustment portion or element 35 of the volume control-switch combination 32 can readily be obtained by axially slitting the collar 52 at various suitable locations, which also facilitates snap-on of the collar 52 over the adjustment rim 35. The rim 35 then can be formed with small projections engaging in slits of the collar 52. Various other ways of engagement, for example by means of a screwdriver slot in the adjustment element 35, which fits into a small projection (not shown) extending from the button 50 within the collar 52, may be used.

The button, generally in concave or inwardly bulged disk form, is internally hollow, at least in the region above the sound receiving opening 42 to form a small sound chamber.

For maintenance or adjustment and matching of the amplifier to individual requirements of the user, the button 50 can be snapped off, and the trimmer resistors 33 can then be adjusted by a screwdriver, engaging the screwdriver slots of the heads 36. Thus,the heads 36 are easily accessible for adjustment and control, and, further, the sound receiving opening 42 is protected upon reassembly of the button 50.

The second PCB 31 need not be mechanically connected to the first PCB 32; rather, it can be secured to the upper housing portion 13, for example by screws or the like. Preferably, the housing is made of plastic. The housing portions 11, 12 may be secured together by interlocking projection-and-recess engagement arrangements,for example similar to the collar 52 on the rim 35, other snap-in connections or, if access to the interior of the housing is to be prevented, by a plastic adhesive. The PCBs 27, 31, likewise, can be retained within the respective housing portions by adhesives, screws, or any other well known and suitable arrangements.

Various changes and modifications may be made within the scope of the inventive concept.

We claim:

1. Hearing aid adapted to be worn in or immediately adjacent the auditory canal of a user,having a housing (11, 13) formed with a sound receiving opening (42) and a first flat end wall (14), a movable user-engageable volume control button (50) located on the housing, and comprising an arrangement to protect the sound receiving opening (42) from external contamination and from masking by a finger of the user during contact with the volume control button (50), wherein, in accordance with the invention, the volume control button (50) comprises a disk-like element positioned adjacent, and essentially parallel to the flat end wall (14) of the housing, the sound receiving opening (42) is located in the flat end wall of the housing, passing through the housing, beneath the volume control button, and the volume control button is spaced from the flat end wall (14) of the housing and the sound receiving button by a small and predetermined distance (h), sufficient to permit sound to pass beneath the volume control button and through the opening and into the interior of the housing, while protecting the sound receiving openings from external contamination and from being masked by a finger of the user upon contact of the user's finger with the volume control button.

2. Hearing aid according to claim 1, wherein the flat end wall (14) is formed with further openings (48) positioned beneath the volume control button (50);

and control heads (36) of electrical, adjustable components (33) are provided, extending through said additional openings.

3. Hearing aid according to claim 1, wherein a volume control element (32) is provided;

wherein the flat end wall (14) of the housing is formed with an essentially centrally positioned opening (47);

and said volume control element 32 and the volume control button (50) are formed with interengaging snap-on connection means passing through said opening and coupling the button and the volume control element.

4. Hearing aid according to claim 3, wherein the volume control element (32) is formed with a projecting adjustment rim (35), said adjustment rim passing through said opening (47) in the flat end wall;

and the volume control button is formed with an internall projecting collar (52) defining a resilient snap-over connection on said collar (52), and additionally defining said small predetermined spacing distance (h) between the volume control button (50) and the flat end wall (14) of the housing.

5. Hearing aid according to claim 1, further including a microphone (45) located within the housing (11, 13);

and an elastic tube (43) connecting a sound inlet opening (44) of the microphone (45) with the sound receiving opening (42) formed in said flat end wall (14) of the housing.

6. Hearing aid according to claim 1, wherein said volume control button is internally concave and defines a hollow zone or chamber in the region above the sound receiving opening (42).

7. Hearing aid according to claim 1, wherein the housing is essentially spherical;

and said sound receiving opening (42) is positioned eccentrically with respect to the housing, closer to the edge of the flat end wall (14) than to the center of the housing, just inwardly of the outer rim of the volume control button, said volume control button having a circumferential, at least part-spherical surface continuing the spherical shape of the essentially spherical housing.

8. Hearing aid according to claim 1, wherein the housing defines a body of rotation;

two printed circuit boards (27, 31) are located within the housing, axially staggered above each other, and mechanically and electrically connected together;

and wherein a volume control element (32) is provided, located on the printed circuit board (31) axially closer to the flat end wall (14) of the housing, the two printed circuit boards being releasably connected together, and the printed circuit board (27) axially remote from the flat end wall being essentially irremovably connected in the housing.

9. Hearing aid according to claim 1, wherein the housing defines a body of rotation;

two printed circuit boards (27, 31) are provided, located axially staggered within the housing;

and wherein a volume control adjustment element (32) is provided, secured to the printed circuit board axially closest to the flat end wall (14) of the housing, and attached to one (31) of the printed circuit boards, said one printed circuit board being connected essentially irremovably to the housing, while being mechanically and electrically separably connected to the other printed circuit board (27).

10. Hearing aid according to claim 8, wherein the housing is formed in two housing parts, and one each of said printed circuit boards is connected to a respective housing part (13–31; 11–27).

11. Hearing aid according to claim 9, wherein the housing is formed in two housing parts, and one each of said printed circuit boards is connected to a respective housing part (13–31; 11–27).

12. Hearing aid according to claim 1, wherein the housing is essentially truncated , spherically shaped.

13. Hearing aid according to claim 1, wherein the housing (11, 13) comprises plastic.

14. Hearing aid according to claim 1, wherein the housing comprises two housing parts (11, 13) which, together, define an essentially truncated , spherical shape;

two printed circuit boards (27, 31) are located within the housing, one, each, in one of the housing parts, and securely connected to the respective housing part;

wherein electrical and mechanical interconnecting elements are provided on said printed circuit boards, for electrically and mechanically connecting said printed circuit boards together upon assembly of said housing parts to define said truncated, essentially spherical shape;

wherein a volume control element (32) is provided, located on that one of the printed circuit boards which is axially closest to said flat end wall (14), the flat end wall being formed with an opening (47) therein to permit passage of an adjustment element (35) on said volume control element (32) to pass therethrough;

and wherein the volume control button is formed with a resilient internally projecting collar engaging the adjustment element (35) of the volume control, the button being internally concave and hollow, covering said sound receiving opening (42) while defining a chamber-like space thereover.

* * * * *